United States Patent [19]

Tanaka et al.

[11] 4,283,614

[45] Aug. 11, 1981

[54] COOKING DEVICE WITH HIGH-FREQUENCY HEATING MEANS AND RESISTANCE HEATING MEANS

[75] Inventors: Junzo Tanaka, Fujiidera; Toshio Kai, Nara; Hitoshi Kurita, Yamatokoriyama, all of Japan

[73] Assignee: Matsushita Electric Industrial Co., Ltd., Osaka, Japan

[21] Appl. No.: 10,054

[22] Filed: Feb. 7, 1979

[30] Foreign Application Priority Data

Feb. 20, 1978 [JP] Japan ..... 53/18949
Apr. 19, 1978 [JP] Japan ..... 53/46991

[51] Int. Cl.[3] ..... H05B 6/64

[52] U.S. Cl. ..... 219/10.55 R; 219/10.55 B; 219/10.55 F; 219/10.55 E; 219/400; 126/21 A

[58] Field of Search ..... 219/10.55 F, 10.55 E, 219/10.55 R, 10.55 M, 10.55 B, 10.55 A, 400; 126/21 A, 21 R

[56] References Cited

U.S. PATENT DOCUMENTS

| | | | |
|---|---|---|---|
| 3,428,772 | 2/1969 | Wallenfels | 219/10.55 E |
| 3,692,968 | 9/1972 | Yasuoka | 219/400 X |
| 3,936,627 | 2/1976 | Fitzmayer | 219/10.55 F |
| 4,029,926 | 6/1977 | Austin | 219/10.79 X |
| 4,071,738 | 1/1978 | Jenn et al. | 219/400 |
| 4,092,512 | 5/1978 | Suzuki et al. | 219/10.55 F |
| 4,121,510 | 10/1978 | Frederick | 219/10.55 E |
| 4,131,778 | 12/1978 | Tanaka et al. | 219/10.55 F |
| 4,154,861 | 5/1979 | Smith | 219/10.55 M X |

*Primary Examiner*—Gene Z. Rubinson
*Assistant Examiner*—Philip H. Leung
*Attorney, Agent, or Firm*—Burgess, Ryan and Wayne

[57] ABSTRACT

A cooking device with one cooking or heating chamber in which food may be heated by either one or both of high-frequency heating means and the resistance heating means. The high-frequency or microwave energy is radiated into the heating chamber from the top while the air heated to high temperatures by the resistance heating means disposed within a rear chamber defined back of the rear wall of the heating chamber is circulated therethrough by a circulation fan. Food charges are placed on a receptacle which in turn is placed on a turntable, whereby the food charges may be uniformly heated. The simultaneous use of both the high frequency heating means and the resistance heating means may enable a more wide variety of food to be cooked by a more wide variety of methods.

6 Claims, 9 Drawing Figures

COOKING DEVICE WITH HIGH-FREQUENCY HEATING MEANS AND RESISTANCE HEATING MEANS

BACKGROUND OF THE INVENTION

The present invention relates to a cooking device provided with both high-frequency or microwave heating means and resistance heating means.

The so-called range-ovens or oven-ranges capable of heating food by microwave heating or resistance heating in the same heating or cooking chamber have been devised and mass produced. In general, the heating chamber is provided with upper and lower tubular resistance heating elements or units. The arrangements of the lower heating elements may be classified in general into two types. In one type, the lower heating element is located between the bottom wall of the heating chamber and a turntable mounted for rotation thereon so that the turntable may be rotated even in the case of the resistance heating. This type is disadvantageous in that the setting of a food receptacle such as a tray on the turntable or the removal therefrom is difficult and that the cleaning of the heating chamber is also difficult because of a relatively large number of component parts mounted on the bottom wall. In the other type, the turntable must be removed out of the heating chamber in case of the resistance heating and instead the lower heating element must be placed in position. On the other hand, in the case of the microwave heating, the lower heating element must be removed and the turntable must be placed. Thus the cooking operations are very cumbersome.

There has been also devised and demonstrated a cooking device wherein the hot air is charged from the top into and forced circulated through the heating chamber by a blower or an air circulation fan. The cooking device of this type is not so popular among the users because the portions of a food charge directly exposed to heated air may be browned and well heated while unexposed portions are not browned and not heated to a desired temperature. As a result, bakery products such as bread, cakes and the like cannot be prepared satisfactorily.

When the resistance heating arrangements of the types described above are combined with microwave heating means, a turntable must be provided so that the satisfactory microwave propagation or radiation may be attained in the heating chamber.

SUMMARY OF THE INVENTION

Accordingly, one of the objects of the present invention is to provide a cooking device provided both microwave heating means and resistance heating means, wherein a turntable and hence food charges are turned both in the microwave heating mode and the resistance heating mode so that an optimum temperature distribution may be attained in the heating chamber and consequently the food charges may be uniformly heated or cooked.

Another object of the present invention is to provide a cooking device of the type described above, wherein a food receptacle may be easily placed onto or removed out of the turntable only by pushing or pulling the receptacle, whereby the putting in and out of the food charges may be remarkably improved.

A further object of the present invention is to provide a cooking device of the type described above, wherein at least two food receptacles may be stacked on the turntable in a suitable vertically spaced apart relationship so that food charges on them may be processed simultaneously, whereby the cooking time may be considerably reduced and the power consumption may be also decreased accordingly.

A further object of the present invention is to provide a cooking device of the type described above wherein a roasting receptacle may be removably placed on the turntable when a food charge such as a chicken is roasted, the roasting receptacle being so designed and constructed that thick, oily fluids or juices oozed out of the food charge being roasted may be effectively preventing from scattering, thus contaminating the interior walls of the heating chamber.

A yet further object of the present invention is to provide a cooking device of the type described above wherein catalytic, self-cleaning layers are coated over the interior wall surfaces of the heating chamber and a rear chamber and circulation fan blades so that thick, oily fluids attached to them may be dissociated and consequently the cleaning of the heating chamber may be much facilitated.

A still further object of the present invention is to provide a cooking device of the type described, wherein the walls of the heating chamber may be made thin in thickness so that the heat capacity of the heating chamber may be reduced to a minimum, and the heating chamber is enclosed by heat insulation plates or casings in an improved manner, whereby the temperature within the heating chamber may be raised quickly with the resultant savings in energy and furthermore the operations may be facilitated.

Yet another object of the present invention is to provide a cooking device of the type described above which may be made compact in size and light in weight and may use a small-sized motor which drives both the turntable and the air circulation fan.

Briefly stated, the present invention provides, to the above and other ends, a cooking device provided with both a microwave heating means and a resistance heating means, said device comprising a cabinet or housing, a heating or cooking chamber defined within the cabinet or housing for heating food charges, a rear chamber defined behind the rear wall of the heating chamber by a deep drawn casing or wall U-shaped in cross section and separated from the heating chamber by the rear wall thereof, a resistance heating means disposed in the rear chamber for heating the air to high temperatures, a fan means at least the fan blades of which are disposed for rotation in the rear chamber so as to recirculate the heated air between the rear chamber and the heating chamber, thereby raising the temperature in the heating chamber, a microwave or high-frequency generating means electromagnetically coupled to the heating chamber in such a way that the microwave or high frequency wave may be radiated into the heating chamber through an inlet opening formed through the top wall at the center thereof, a turntable disposed for rotation in a recess formed in the bottom wall of the heating chamber in such a way that the top of the turntable may be substantially in coplanar relationship with the upper surface of the bottom wall of the heating chamber, a plurality of equiangularly spaced apart rollers in the recess in the bottom wall for rotatably supporting the turntable, a receptacle means made of a dielectric such as glass or porcelain and removably placed on the turntable, and a common drive means for driving not only the fan means through a belt drive system but also the turntable through a belt drive system, a reduction gear and a magnetic coupling means.

The above and other objects, features and advantages of the present invention will become more apparent from the following description of a preferred embodiment of a cooking device of the present invention taken in conjunction with the accompanying drawings.

BRIEF DESCRIPTION OF THE DRAWINGS

Same reference numerals are used to designate similar parts throughout the figures.

DESCRIPTION OF THE PREFERRED EMBODIMENT

Figure 1:
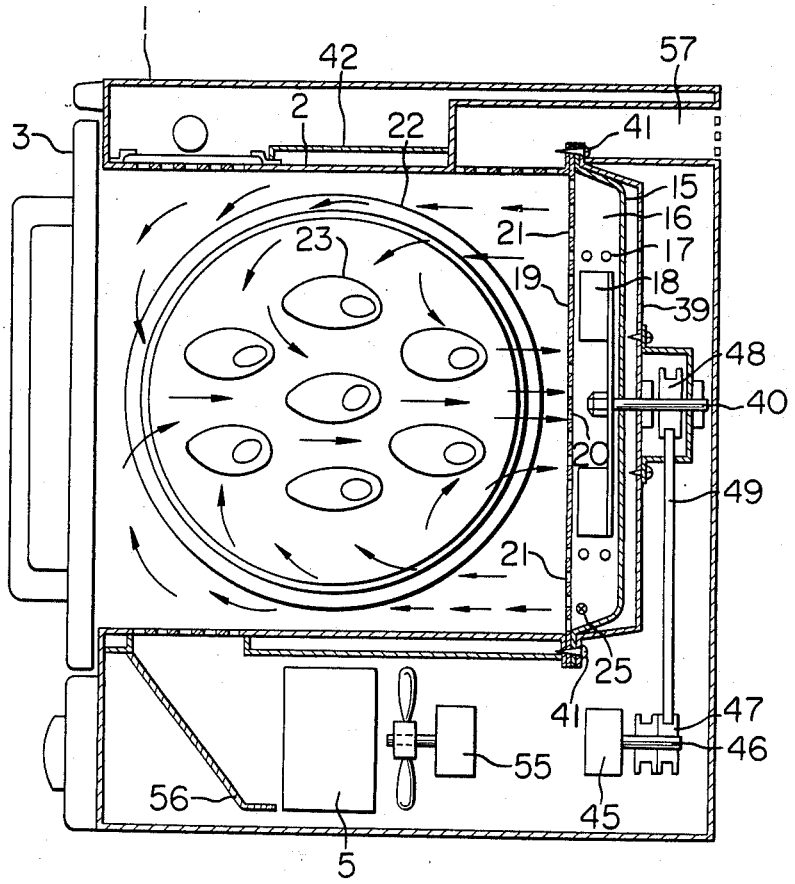
FIG. 1 is a top view of a cooking device in accordance with the present invention, the top wall being removed.
Figure 2:
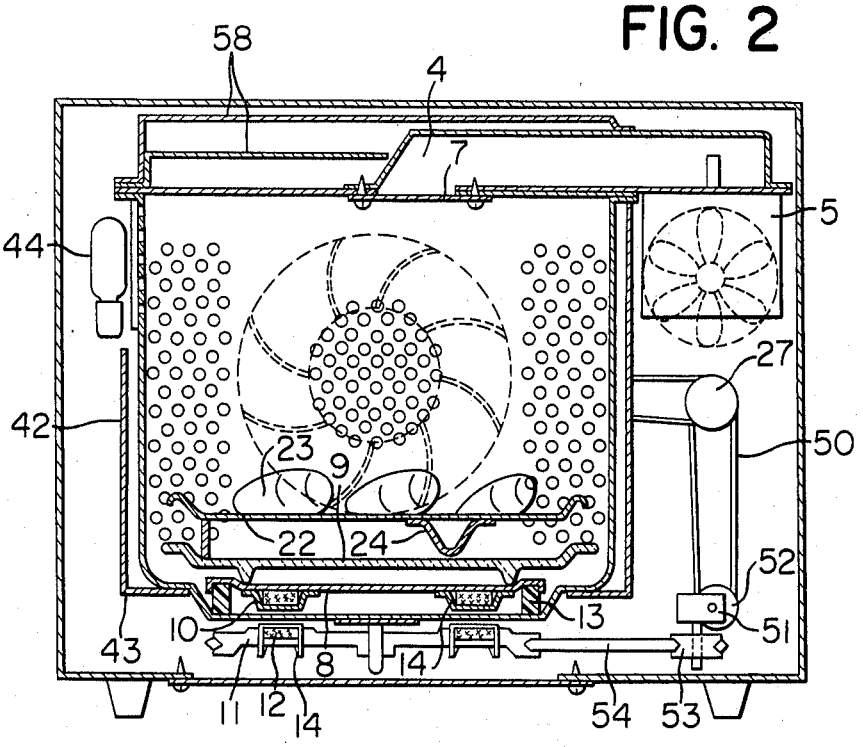
FIG. 2 is a front view thereof with the door and the front wall panel removed.
Figure 3:
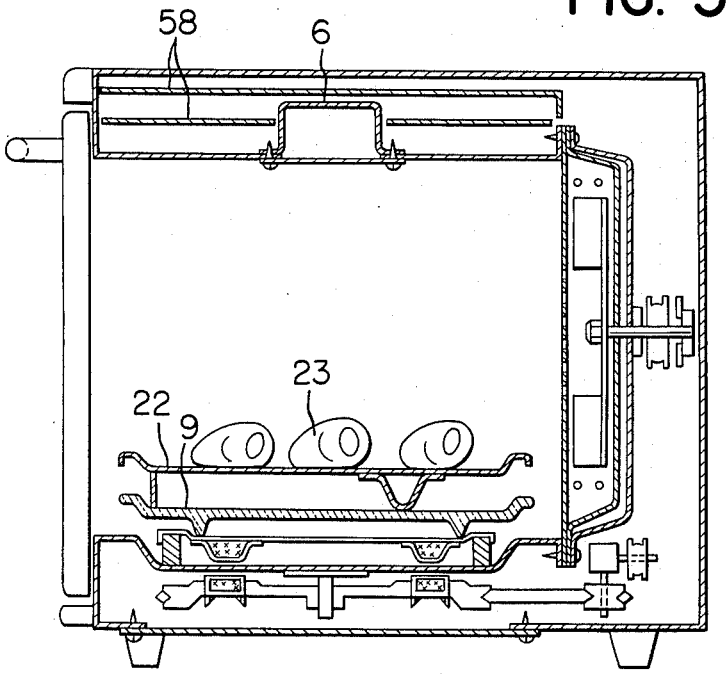
FIG. 3 is a side view thereof with the side wall removed.

Referring to FIGS. 1 and 2, a cooking device in accordance with the present invention comprises, in general, a cabinet or housing 1 having a bottom wall, a top wall, a rear wall, a front wall with a door 3 and side walls. Within the cabinet or housing 1 is defined a heating chamber 2 in which food is heated either by resistance heating or high-frequency heating.

A high-frequency generator or a magnetron 5 is electromagnetically coupled through a wave guide 6 and a feed opening 4 with the heating chamber 2. The feed opening 4 is covered with a dielectric cover 7 so as to prevent the intrusion of fine particles, water vapor and so on into the wave guide 6.

On the bottom of the heating chamber 2 is disposed a turntable 8 which may be rotated magnetically as will be described in detail hereinafter. In order to receive this turntable 8, the bottom of the heating chamber is formed with a circular recess in which a plurality of rollers 13 are equiangularly disposed for supporting the turntable 8. A plurality of first or driven magnets 10 are equiangularly mounted on the undersurface of the turntable 8 while a plurality of second or driving magnets 12 are equiangularly mounted in opposed relationship with the first or driven magnets 10 on a pulley 11 which is rotatably mounted in coaxial relationship with the turntable 8 on the undersurface of the bottom wall of the heating chamber 2 as best shown in FIG. 2 and is drivingly coupled to a motor to be described below through a V-belt drive system as will be described in detail hereinafter. Therefore upon rotation of the pulley 11, the turntable 8 is magnetically rotated in one direction along the rollers 13 as is well known to those skilled in the art. The bottom wall of the heating chamber 2 as well as the portion 14 of the pulley 11 which supports the second or driving magnets 12 are made of a non-magnetic metal such as SUS304 or aluminum. A first receptacle or a circular tray 9 which is mounted removably upon the turntable 8 is made of a dielectric such as glass, porcelain or enamel because it is mainly used for receiving food which is heated by high-frequency heating.

As best shown in FIG. 1, the rear wall 19 of the heating chamber 2 is covered with a deep dish-shaped casing or partition wall so as to define a rear chamber 16 separated from the heating chamber 2. The rear wall 19, the rear chamber casing 15 and a heat insulation plate or casing 39 are securely attached with screws 41 to the flanges of the heating chamber 2.

Within the rear chamber 16 thus defined are disposed heating elements or resistors 17 to be described in detail hereinafter and a fan 18 for recirculating the air in the heating chamber 2 and the rear chamber 16 through suction holes 20 and discharge holes 21 formed through the rear wall 19. The suction holes 20 are concentrated around the extension of the axis of the driving shaft 40 of the fan 18 while the discharge holes 21 are radially outwardly spaced apart from the suction holes 20. Therefore upon rotation of the fan 18, the air is forced to recirculate through the heating chamber 2 and the rear chamber 16. That is, the hot air is forced to flow through the discharge holes 21 into the heating chamber 2 while the relatively cool air is sucked through the suction holes 20 into the rear chamber 16 to be reheated by the heating elements 17, whereby food charges 23 on a second receptacle or a circular tray 22 with legs 24 placed on the first receptacle 9 which in turn is placed on the turntable 8 may be heated. The second receptacle 22 is made of a metal and coated with enamel and is spaced upwardly of the first receptacle 9 by the legs 24 so that the heated air discharged through the lower discharge holes 21 may flow through the space between the first and second receptacles 9 and 22 and consequently the second receptacle 22 is heated to a high temperature, whereby the food charges 23 may be suitably browned. The second receptacle with legs formed integral with said first receptacle are made of a metal and entirely coated with enamel.

A temperature sensor 25 is located in the rear chamber 16 on the side of the discharge holes 21 so that when the temperature of the atmospheric air in the heating chamber 2 rises a predetermined level, the power supplied to the heating elements 17 is suitably controlled in response to the signal from the temperature sensor 25, whereby the temperature in the heating chamber 2 may be maintained at a desired temperature range.

As described hereinbefore, according to the present invention, the heating elements 17 and the fan 18 are disposed within the rear chamber 16 defined behind the rear wall 19 of the heating chamber 2 in such a way that the air heated to high temperatures by the heating elements 17 may be recirculated by the fan 18 through the discharge and suction holes 21 and 20 between the heating chamber 2 and the rear chamber 16. Simultaneously, the food charges 23 are turned as they are placed on the turntable 8. Therefore the present invention may attain the following effects, features and advantages:

(1) The hot air flows horizontally impinge against the food charges 23 so that not only the upper surfaces but also the side surfaces of the food charges 23 may be heated and browned. If the food charges 23 were not turned, the hot air would blow against only localized portions of the food charges 23 so that these area could be well heated and browned but the portions opposite in direction to the former portions would not be heated and browned. According to the present invention, however, the food charges 23 are placed on the turntable 8 so that as they make one revolution, every portion thereof may be uniformly subjected to the hot air flows so that the food charges 23 may be uniformly heated.

(2) The second receptacle 22 upon which are placed the food charges 23 to be heated by the Joule heat is spaced apart from the first receptacle 9 upwardly thereof by the legs 24 so that the space through which the hot air flows discharged from the discharge holes 21 may freely flow may be defined between the first and second receptacles 9 and 22 and consequently the undersurface of the second receptacle 22 may be heated. Furthermore the uniform heating of the undersurface of the second receptacle 22 may be ensured because the second receptacle 22 is placed on the first receptacle 9 which in turn is placed on the turntable 8 and consequently as the turntable 8 rotates the second receptacle 22 is also rotated. Thus the lower portions of the food charges 23 may be also uniformly heated and browned.

(3) Both the first and second receptacles 9 and 22 are circular in shape and have no corner as in the case of a rectangular or a square receptacle which causes the staggering of the hot air flows. Therefore the hot air may freely circulate through the heating chamber 2 in every direction so that the uniform temperature distribution therein may be ensured.

(4) Since the heating elements or resistors 17 and the circulation fan 18 are disposed within the rear chamber 16 separated from the heating chamber 2 through the rear wall 19, the high-frequency generator and its associated component parts may be freely disposed upon the heating chamber 2. As a result, the position of the feed opening 4 may be so selected that an optimum propagation of the high frequency waves may be ensured within the heating chamber 2.

(5) When the feed opening 4 is located nearly at the center of the top wall of the heating chamber 2, the microwaves are propagated in the zero mode in the direction of height of the heating chamber and in the odd-number modes in both the widthwise and depthwise, whereby the most efficient microwave distribution may be attained in the heating chamber 2. In addition, when a rotary antenna is mounted in coaxial relationship with the feed opening 4, more highly efficient distribution may be attained.

Figure 4:
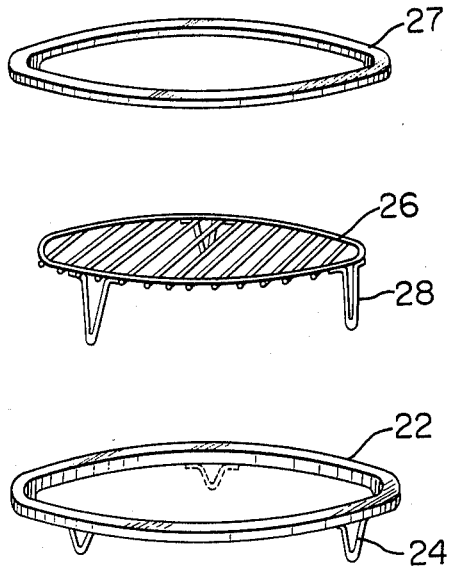
FIG. 4 shows, in perspective view, a second food receptacle, a grill-shaped food receptacle and a third food receptacle which may be removably stacked upon a turntable in the order named.

(6) When, as shown in FIG. 4, a spacer or a circular grid 26 with legs 28 is placed on the second receptacle and a third receptacle or a circular tray or the like 27 is placed upon the spacer or grid 26, food charges may be stacked in two stages. That is, a relatively large number of food charges 23 may be heated simultaneously. Since the third receptacle 27 is sufficiently upwardly spaced apart from the second receptacle 22, the hot air may freely flow between them so that the undersurface of the third receptacle 27 is also heated as in the case of the second receptacle 22 and consequently the effects (1), (2) and (3) may be also obtained.

When the grid 26 is made of a suitable material, it may be used to heat a food charge such as fish which tends to ooze oil or the like when heated by the high-frequency heating. The dripping oil or the like may be received in the second receptacle 22.

Figure 5:
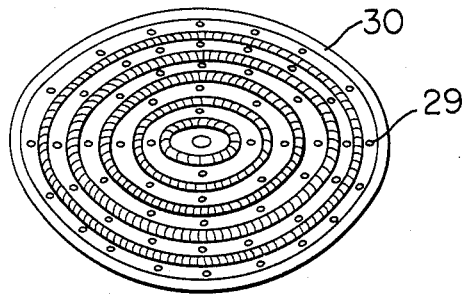
FIG. 5 is a perspective view of a roasting receptacle which may be removably placed on a first receptacle which in turn is placed on the turntable, a food charge such as a chicken being placed on the roasting receptacle when it is roasted.
Figure 6:
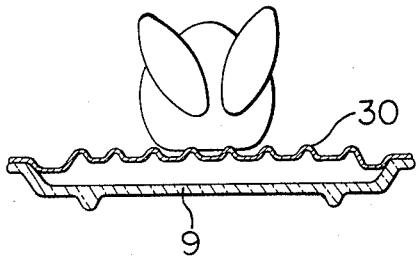
FIG. 6 is a sectional view in elevation thereof when placed on the first receptacle.

So far the description of the cooking device of the present invention has been limited to heating food charges such as cakes, bread and so on. Next the method for heating a food charge such as a chicken which oozes oil or the like when heated will be described. In this case, as shown in FIG. 6, instead of the second receptacle 22, a roasting receptacle 30 is placed on the first receptacle 9. The roasting receptacle 30 is formed with many concentric ridges and valleys and a plurality of equiangularly spaced apart drain holes 29 formed in each valley as shown in FIG. 5. A food charge such as a chicken 31 is placed on the roasting receptacle 30. As the chicken 31 is roasted, thick liquids such as oil ooze out of the chicken 31, are collected in the valleys and drop through the drain holes 29 into the first receptacle 9. As a result, the contamination of the hot air recirculated may be avoided. The air contamination is mainly caused in the oven by the scattering of thick, oily fluids oozed out of the food charge or chicken 31. Scattering of thick fluids most frequently occurs when a droplet of thick, oily fluid further drops onto a body of collected thick, oily fluids which is heated. If what the chicken 31 oozes was only oil, scattering would be less, but almost one half of the fluids oozed out of the chicken consists of water so that wide scattering occurs in all directions. According to the present invention, thick, oily fluids oozed out of the chicken 31 are not heated to high temperatures and even when they drop through the drain holes 29 of the roasting receptacle 30 into the first receptacle 9 which is rotating and are scattered, scattered droplets are prevented by the roasting receptacle 30 so that the adhesion of thick, oily fluids to the interior wall surfaces of the heating chamber 2 may be minimized. As a consequence, the cleaning of the heating or cooking chamber 2 may be much simplified.

Furthermore according to the present invention, the concentric ridges of the roasting receptacle 30 are progressively radially outwardly decreased in height as shown in FIG. 6 so that the food charge or chicken 31 may be more uniformly exposed to the hot heat and well roasted.

The roasting receptacle 30 may be made of steel or may be drawn from a sheet steel and punched and thereafter coated with enamel. Therefore even when both the heating units 17 and the magnetron 5 are simultaneously energized or when they are sequentially and continuously energized, discharges due to microwave propagation will not occur so that the cooking time may be considerably reduced as compared with the conventional ovens or ranges or combinations thereof.

Next referring back to FIGS. 1 and 2, the rear wall 19 of the heating chamber 2 will be described in more detail. The diameters of the air suction and discharge holes 20 and 21 formed therethrough must be such that no leakage of microwaves will result. The sides of the rear wall 19 are spot-welded to the bottom wall, the side walls and the top wall of the heating chamber 2 and their joints are masked with catalytic self-cleaning layers which have a function of dissociating oils and the like. More particularly, the rear wall 19 is made of a steel plate coated with an aluminum film to a thickness of from 0.4 to 0.6 mm, further coated to a thickness of about 200 microns with a mixture consisting of frit, which forms an enamel layer, and a catalyst mainly consisting of $MnO_2$.

Figure 7:
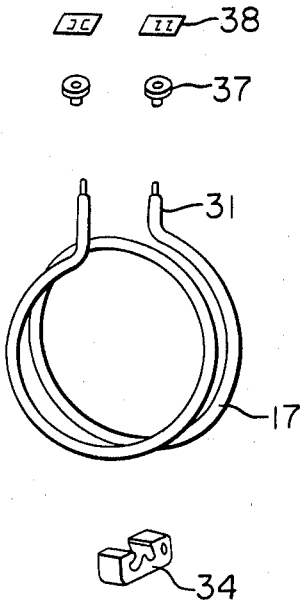
FIG. 7 is an exploded perspective view of a resistance heating element and its associated parts.
Figure 8:
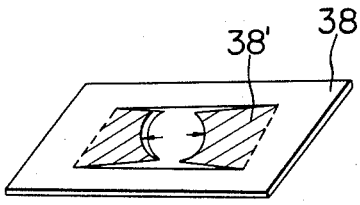
FIG. 8 is a perspective view of a push nut used for retaining the ends of the resistance heating element shown in FIG. 7.
Figure 9:
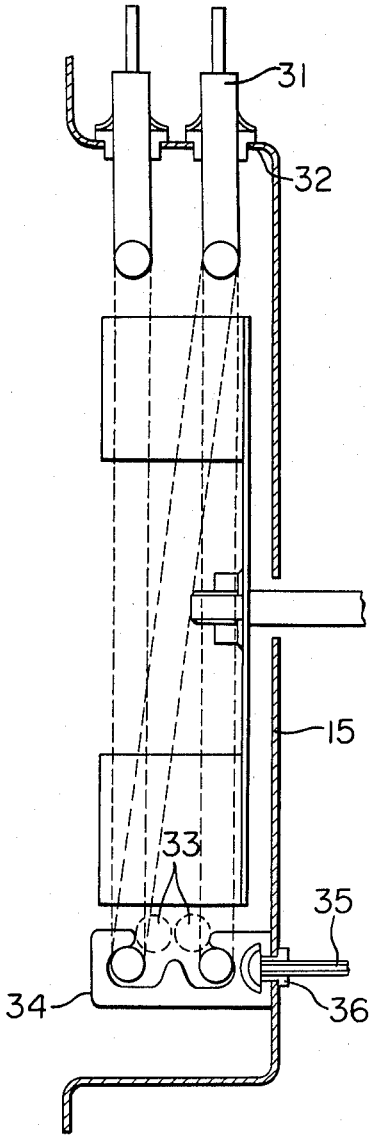
FIG. 9 is a side view, on enlarged scale, of the resistance heating element mounted in a rear chamber behind a heating or cooking chamber.

Next referring to FIGS. 7, 8 and 9, the mounting of the heating unit or element 17 will be described. As shown in FIG. 7, the present invention uses a coiled, tubular heating element; that is, a resistor encased in a tubular sheath. As shown in FIG. 9, after the ends 31 of the tubular heating element 17 have been extended through holes 32 of the rear chamber wall 15, the tubular heating element 17 is compressed as indicated by the broken lines so that it may be passed and extended through an insulator 34. When the tubular heating element 17 is released, it is expanded to restore its initial shape so that it will not be removed out of the insulator 34. Thereafter the insulator 34 is securely attached with a screw 35 and a nut 36 to the rear chamber wall 15. Next, as shown in FIG. 7, insulators 37 are fitted over the ends 31 of the heating element 17 extended out of the holes 32 and into the holes 32. Thereafter push nuts 38 (See FIG. 8) are fitted over the ends 31 so that the heating element 17 may be securely attached to the rear chamber wall 15. The push nuts 38 are made of an elastic material and formed with a hole the diameter l of which is slightly smaller than that of the tubular heating element 17. Therefore when the push nuts 38 are forced to fit over the ends 31 of the heating element 17, the struck out portions spring back to securely retain the ends 31 in position, thereby preventing the heating element 16 from being pulled out of the push nuts 38. The struck-out portions are hatched in FIG. 8.

Since the heating coil is encased in the tubular sheath and the tubular heating element 17 is mounted in the manner described above, even when the heating coil should be broken off or cut off, it may be prevented from making contact with the rear chamber wall 15 and the rear wall 19 of the heating chamber 2, thereby causing a shortcircuit. Furthermore, the assembly may be facilitated so that great economical advantages may be attained.

Next the air circulation fan 18 and its driving system will be described in detail below. The fan 18 is mounted not on the rear chamber wall 15 but on the heat insulation plate 39 which encloses the rear chamber wall 15. In assembly, the rear chamber wall 15 and the heat insulating plate 39 are assembled first, and then the driving shaft 40 with a driven pulley 48 is mounted. Thereafter, the fan blade assembly is mounted on the driving shaft 40, and the heating elements 17 are mounted on the rear chamber wall 15 in the manner described above. The sub-assembly thus provided in turn is mounted on the rear wall 19 of the heating chamber 2 with the screws 41. As with the rear wall 19 of the heating chamber 2, at least the blades of the air circulation fan 18 are coated with the self-cleaning layers in the manner described above. As a result, even when the rear wall 19, the fan 18 and the rear chamber wall 15 are exposed to the oil-ladden air which is recirculated in the manner described above and contaminated with thick, oily fluids, the self-cleaning layers may effectively dissociate them so that the air circulation passage defined by them may be always kept clean. It is to be emphasized that the cleaning effects are such that it is not needed at all to remove them so as to clean them. Furthermore, the catalytic self-cleaning layers used in the present invention are such that the higher the temperature they are heated, the more pronounced the self-cleaning effects they exhibit become.

The mounting of the pulley 48 and the driving shaft 41 including its bearing upon the heat insulation plate 39 is advantageous in that a load carried by the rear chamber wall 15 may be minimized and consequently the wall 15 may be made thin with the resultant economical advantages. Furthermore, the overall heat capacity of the rear chamber 16 may be minimized so that the heating chamber 2 may be quickly raised to high temperatures. Furthermore the heat dissipation from the pulley 48 and so on may be minimized. Therefore a high thermal efficiency may be attained. Moreover, since the pulley 48 and its associated components are mounted on the heat insulation plate 39, they may be made of a material with less resistance to heat.

Next referring to FIG. 2, heat insulation plates 42 which are generally L-shape in cross section are disposed in spaced apart relationship with the side walls of the heating chamber 2, and the horizontal portions 43 of the heat insulation plates 42 are made into contact with the bottom wall of the heating chamber 2. The space between the upright portion of each heat insulation plate 42 and the side wall of the heating chamber is so selected that no convection of air will not occur and the air in this space serves as a heat insulating medium. The displacement of the heat insulation plates 42 may be permitted as long as their horizontal portions 43 keep contact with the bottom wall of the heating chamber 2 so that the assembly may be much facilitated. Since there exists no upward flow of the hot air through the space between the heat insulating plate 42 and the side wall of the heating chamber 2, accessaries such as a lamp 44 may be positioned in a cut-out portion of the heat insulation plate 42.

Both the turntable 8 and the air circulation fan 18 are driven by a common motor 45. An endless belt 49 passes the driven pulley 48 carried by the shaft 40 of the fan 18 and a driving pulley 47 carried by or formed integral with a drive shaft 46 of the motor 45 as shown in FIG. 1, whereby the fan 18 is driven. The motor 45 is also drivingly coupled through a belt drive system to an intermediate pulley 27 which in turn is drivingly coupled with an endless belt 50 to a pulley 52 carried by an input shaft of a worm gearing 51. An output shaft of the worm gearing 51 carries a pulley 53 which in turn is drivingly coupled with an endless belt 54 to the pulley 11 attached to the turntable 8 as shown in FIG. 2. Therefore upon rotation of the motor 45, the turntable 8 is rotated.

Since the motor 45 is mounted in spaced apart relationship with the side wall of the heating chamber 2 as best shown in FIG. 1, it may be made small in size and its reliability may be considerably improved. Thus the present invention may attain further economical advantages. In addition, the cooking device may be made compact in size because the depth (that is, the distance between the front and rear walls of the cabinet or housing 1) may be reduced.

Another motor-driven fan 55 is provided in order to cool the magnetron 5 as shown in FIG. 1. The air passing along the magnetron 5 is directed by an air guide or deflector 56 so as to flow into the heating chamber 2 through air inlet holes formed through the side wall thereof. Water vapor generated from the food charges 23 in the high-frequency heating mode is exhausted through an exhaust duct 57 into the surrounding atmosphere.

Referring back to FIG. 2, heat insulation plates or casings 58 are disposed between the top wall of the heating chamber 2 and the top wall of the cabinet or housing 1 so that the heat transfer from the heat chamber 2 to the top wall of the cabinet or housing 1 may be minimized.

The novel features, effects and advantages of the present invention may be summarized as follows:

(1) In both the resistance heating mode and the high-frequency heating mode, the food charges are revolved as described elsewhere so that optimum and accordingly efficient heating conditions may be established. In the case of resistance heating, the heating units or elements 17 heat the air and the circulation fan 18 circulates the heated air through the heating chamber 2 so that every side of the food charge 23 may be exposed to the hot air. In other words, the uniform temperature distribution may be attained within the cooking chamber 2.

(2) The turntable 8 is disposed within the circular recess formed in the bottom wall of the heating chamber 2 in such a way that the top of the turntable may be nearly in coplanar relationship with the bottom wall so that in both the resistance heating and high-frequency heating modes, the first receptacle 9 may be easily placed on the turntable 8 or removed therefrom. The turntable 8 is magnetically driven so that its cleaning may be much facilitated.

(3) Since the heating elements 17 and their associated component parts are not disposed in the heating chamber 2, a space available in the latter may be increased. In addition, in the case of the high-frequency heating, the microwave propagation loss may be minimized and adverse effects on the microwave propagation may be eliminated. Furthermore, cleaning of the heating chamber 2 may be facilitated.

(4) Even when the high-frequency heating and the resistance heating are made simultaneously or the high-frequency heating is switched immediately to the resistance heating or vice versa, no spark occurs so that the safety in operation may be ensured. Furthermore, a more variety of food may be cooked by a more wide variety of cooking methods, and the heating or cooking time will be considerably reduced.

What is claimed is:

1. A cooking device utilizing high frequency and forced hot air heating means, comprising:

a housing having a front heating chamber and a rear chamber therein, said front chamber having front, rear, top and bottom walls, and two side walls;

means for permitting charges to be heated to be placed in and removed from said front chamber;

said housing including an apertured wall between said chambers for permitting air flow therebetween, the apertures of said wall comprising a central group of apertures for air movement in one direction through said wall, and a peripheral group of apertures for air movement in the opposite direction through said wall;

fan means having fan blades disposed in said rear chamber for forcing a flow of air from said rear chamber into said front chamber in a horizontal direction extending toward said front wall of said front chamber, through one of said groups of apertures, said air flow returning to said rear chamber through the other of said groups of apertures;

a resistance heating coil disposed in said rear chamber adjacent one group of apertures for heating air prior to flow thereof into said front chamber;

a thermally insulating plate defining a rear wall of said rear chamber;

driving means mounted on said insulating plate for supporting and rotating said fan means;

means for propagating high-frequency electromagnetic wave energy into said front heating chamber from a region adjacent said top wall thereof;

a horizontal turntable rotatably mounted within said front heating chamber adjacent the bottom thereof, in a recess in said bottom wall, for receiving said charges;

means for rotating said turntable;

a first receptacle disposed on said turntable;

a second metal receptacle removably disposed on said first receptacle for rotation in unison therewith, said second receptacle having legs the length or height of which are such that the hot air discharged from said rear chamber into said front chamber by said fan means may freely flow through the space between said first and second receptacles; and a layer of self-cleaning catalytic material disposed on said fan blades and on said apertured wall;

whereby the rotation of said turntable distributes the heating effect of said wave energy with respect to said charges, and cooperates with said horizontal forced air flow to provide substantially uniform browning of all exposed surfaces thereof.

2. A cooking device as defined in claim 1 wherein said second receptacle has legs formed integral with said first receptacle and is coated with enamel.

3. A cooking device as defined in claim 1 further comprising a grill-like receptacle is provided with legs is provided which may be removably placed on said second receptacle, and a third receptacle, similar in material to said second receptacle, which may be removably placed on said grill-like receptacle, whereby food charges placed on said second and third receptacles may be heated or otherwise cooked at the same time.

4. A cooking device utilizing high frequency and forced hot air heating means, comprising:

a housing having a front heating chamber and a rear chamber therein, said front chamber having front, rear, top and bottom walls, and two side walls;

means for permitting charges to be heated to be placed in and removed from said front chamber;

said housing including an apertured wall between said chambers for permitting air flow therebetween, the apertures of said wall comprising a central group of apertures for air movement in one direction through said wall, and a peripheral group of apertures for air movement in the opposite direction through said wall;

fan means having fan blades disposed in said rear chamber for forcing a flow of air from said rear chamber into said front chamber in a horizontal direction extending toward said front wall of said front chamber, through one of said groups of apertures, said air flow returning to said rear chamber through the other of said groups of apertures;

a resistance heating coil disposed in said rear chamber adjacent said one group of apertures for heating air prior to flow thereof into said front chamber;

a thermally insulating plate defining a rear wall of said rear chamber;

driving means mounted on said insulating plate for supporting and rotating said fan means;

means for propagating high-frequency electromagnetic wave energy into said front heating chamber from a region adjacent said top wall thereof, a horizontal turntable rotatably mounted within said front heating chamber adjacent the bottom thereof, in a recess in said bottom wall, for receiving said charges;

means for rotating said turntable;

a first dielectric receptacle removably disposed on said turntable;

a roasting receptacle which may be removably placed on said first receptacle, said roasting receptacle having a plurality of alternating, concentric ridges and valleys and a plurality of equiangularly spaced apart drain holes in each of said concentric valleys; and a layer of self-cleaning catalytic material disposed on said fan blades and on said apertured wall, whereby the rotation of said turntable distributes the heating effect of said wave energy with respect to said charges, and cooperates with said horizontal forced air flow to provide substantially uniform browning of all exposed surfaces thereof.

5. A cooking device as defined in claim 4 wherein said concentric ridges of said roasting receptacle are progressively reduced in height radially outwardly from the innermost ridge thereof.

6. A cooking device utilizing high frequency and forced hot air heating means, comprising:

a housing having a front heating chamber and a rear chamber therein, said front chamber having front, rear, top and bottom walls, and two side walls;

means for permitting charges to be heated to be placed in and removed from said front chamber;

said housing including an apertured wall between said chambers for permitting air flow therebetween, the apertures of said wall comprising a central group of apertures for air movement in one direction through said wall, and a peripheral group of apertures for air movement in the opposite direction through said wall;

fan means having fan blades disposed in said rear chamber for forcing a flow of air from said rear chamber into said front chamber in a horizontal direction extending toward said front wall of said front chamber, through one of said groups of apertures, said air flow returning to said rear chamber through the other of said groups of apertures;

a thermally insulating plate defining a rear wall of said rear chamber;

driving means mounted on said insulating plate for supporting and rotating said fan means;

a resistance heating coil disposed in said rear chamber adjacent said one group of apertures for heating air prior to flow thereof into said front chamber, said resistance heating coil having a few turns disposed radially outwardly of said fan means, the portions of said turns of said resistance heating coil adjacent to said fan means being extended through guide grooves of said thermally insulating plate, said portions being compressed so as to be inserted into said guide grooves and released after insertion so as to restore the initial shapes thereof, thereby abutting against the walls of said guide grooves so as to be securely retained therein, both ends of said resistance heating coil being extended out of said rear chamber and retained in position with push nut means;

means for propagating high-frequency electromagnetic wave energy into said front heating chamber from a region adjacent said top wall thereof;

a horizontal turntable rotatably mounted within said front heating chamber adjacent the bottom thereof, in a recess in said bottom wall, for receiving said charges;

means for rotating said turntable; and a layer of self-cleaning catalytic material disposed on said fan blades and on said apertured wall, whereby the rotation of said turntable distributes the heating effect of said wave energy with respect to said charges, and cooperates with said horizontal forced air flow to provide substantially uniform browning of all exposed surfaces thereof.

* * * * *

UNITED STATES PATENT AND TRADEMARK OFFICE

CERTIFICATE OF CORRECTION

PATENT NO. : 4,283,614

DATED : August 11, 1981

INVENTOR(S) : Junzo Tanaka et al.

It is certified that error appears in the above—identified patent and that said Letters Patent is hereby corrected as shown below:

Column 4, line 18: After "wall", insert --15--.

Column 10, line 33: Cancel "is provided"

line 34: Cancel "is provided"

Signed and Sealed this

Sixth Day of July 1982

[SEAL]

*Attest:*

GERALD J. MOSSINGHOFF

*Attesting Officer*

*Commissioner of Patents and Trademarks*